US006595217B1

(12) United States Patent
Case et al.

(10) Patent No.: US 6,595,217 B1
(45) Date of Patent: Jul. 22, 2003

(54) SMOKING ARTICLES

(75) Inventors: Paul David Case, Southampton (GB); Martin Coleman, Southampton (GB)

(73) Assignee: British-American Tobacco Company Limited, Southampton (GB)

( * ) Notice: Subject to any disclaimer, the term of this patent is extended or adjusted under 35 U.S.C. 154(b) by 1601 days.

(21) Appl. No.: 08/551,576

(22) Filed: Nov. 1, 1995

Related U.S. Application Data

(63) Continuation of application No. 08/192,494, filed on Feb. 7, 1994, now abandoned.

(30) Foreign Application Priority Data

Feb. 23, 1993 (GB) ..... 9303583

(51) Int. Cl.[7] ..... A24D 3/06; D21F 11/00
(52) U.S. Cl. ..... 131/331; 162/91; 162/139
(58) Field of Search ..... 131/331–339, 131/342; 162/91, 158, 139, DIG. 5; 604/364

(56) References Cited

U.S. PATENT DOCUMENTS

| | | | | | |
|---|---|---|---|---|---|
| 1,897,976 | A | * | 2/1933 | Birkholz | 131/331 X |
| 3,161,557 | A | * | 12/1964 | Muller | 131/340 X |
| 3,226,280 | A | * | 12/1965 | Muller | 131/340 X |
| 3,966,543 | A | * | 6/1976 | Cayle et al. | 162/158 |
| 4,085,760 | A | * | 4/1978 | Toyoshima et al. | |
| 4,124,033 | A | * | 11/1978 | Zizka et al. | 131/342 |
| 4,274,428 | A | * | 6/1981 | Muller et al. | 131/340 X |
| 4,547,263 | A | * | 10/1985 | Quame | 162/DIG. 5 |
| 5,568,819 | A | * | 10/1996 | Gentry et al. | 131/331 X |

OTHER PUBLICATIONS

The Condensed Chemical Dictionary, Tenth Edition, Hawley, title pages and p. 870, 1981.*

* cited by examiner

*Primary Examiner*—Steven P. Griffin
*Assistant Examiner*—Dionne A. Walls
(74) *Attorney, Agent, or Firm*—Pitney, Hardin, Kipp & Szuch LLP

(57) ABSTRACT

Cigarette filter rod employs as filtration material moisture disintegrative paper. The moisture disintegration index of the paper does not exceed 20.

2 Claims, No Drawings

SMOKING ARTICLES

This application is a continuation of application Ser. No. 08/192,494 filed Feb. 7, 1994, now abandoned.

BACKGROUND OF THE INVENTION

FIELD OF THE INVENTION

The subject invention relates to smoking articles and has as an objective the provision of improved smoking articles.

SUMMARY OF THE INVENTION

The subject invention provides smoking article filter rod comprising as filtration material moisture disintegrative paper. Should the filter rod comprise wrapper means, then preferably the wrapper means is readily degradable.

The subject invention further provides a smoking article comprising a smoking material rod and a filter, said filter comprising as filtration material moisture disintegrative paper. Preferably, any other components of the filter are readily degradable. It is also preferable that the smoking material rod is readily degradable and that the means inter-attaching the smoking material rod and the filter is readily degradable.

DETAILED DESCRIPTION OF THE PREFERRED EMBODIMENTS OF THE INVENTION

Filter rod according to the subject invention can be made using a filter rod making machine conventional for the making of paper filters, a Decouflé such machine for example. The moisture disintegrative paper must be strong enough for web feed to the rod maker without an undue incidence of paper breakage.

According to a proposed test for paper disintegration, a sample piece of the paper of an area of 500 $cm^2$ is placed in 250 ml of water in a one liter laboratory measuring cylinder. The mouth of the cylinder is sealed, following which the paper sample is subjected to mechanical agitation by virtue of the fact that the cylinder is inverted and then restored to its initial orientation. The paper sample is then observed. This invertion/restoration operation is repeated until it is observed that the paper sample has disintegrated to such an extent that all of the remaining pieces of paper are of an area of 1 $cm^2$ or less. The number of invertion/restoration operations that have been necessary to bring about this result is recorded as being a moisture disintegration index.

For use as moisture disintegrative filtration material for the purposes of the subject invention paper should be of a moisture disintegration index value, as determined by the just detailed test method, not exceeding about 20. Preferably, the index should not exceed about 15 and more preferably the index should not exceed about 10. More preferably still, the index should not exceed about 7, or even about 5.

It has been determined, by use of the above detailed test method, that a typical moisture disintegration index value for a conventional paper for use as filtration material in a smoking article filter is in a range not lower than about 25 to 30.

In a smoking article according to the subject invention it is advantageous for the wrapper of the smoking material rod to be of moisture disintegrative paper. It is also advantageous for the tipping wrapper, or band, of such smoking article to be of moisture disintegrative paper. If the filter of such smoking article comprises a plugwrap, it is advantageous for the plugwrap to be of moisture disintegrative paper.

A filter rod according to the subject invention preferably exhibits a Borgwaldt hardness of between 50% and 95%.

The subject invention yet further provides a smoking article filter comprising as filtration material moisture disintegrative paper.

A filter according to the subject invention preferably exhibits a filtration efficiency in respect of the particulate phase of mainstream smoke of between 10% and 90% (NFDPM).

The length of a filter according to the subject invention may be between 6 mm and 30 mm.

A filter according to the subject invention may comprise particulate smoke modifying material. Such particulate material may be dispersed in folds of the moisture disintegrative paper. Alternatively, such particulate material may be disposed in a cavity bounded by the moisture disintegrative paper. As a further alternative, particulate material may be dispersed in the paper making furnish.

In making filter rod according to the subject invention there may be fed to the filter making machine, simultaneously with the feed thereto of the web or webs of the moisture disintegrative paper, a web or webs of another degradable, preferably moisture disintegrative, material.

In making filter rod according to the subject invention a degradable binder may be applied to the web or webs of moisture disintegrative paper.

The unbound pressure drop of a cigarette according to the subject invention is suitably in a range of 80 mm to 120 mm water gauge.

A cigarette according to the invention can be perforated, as by use of a laser perforator, to provide filter ventilation. Alternatively, pre-perforated material may be used.

Cigarettes according to the subject invention may be of a circumference in a range of 13 mm to 30 mm.

Preferably, the web(s) of moisture disintegrative paper used in making the filter rod is/are crimped. Thus, for example, a web may be fed between a pair of crimping rollers so as to impart to the web a corrugation-form crimp as viewing the web in transverse cross-section. Such crimping rollers may be at elevated temperature, as for example in a range of 70° C. to 150° C. A corrugation-type crimp may be of a depth in a range of, for example, 0.25 mm to 0.70 mm.

For the provision of filter rod in accordance with the subject invention use was made of papers designated A and B. Paper A was the product of a furnish of 50% wood pulp and 50% flaxhemp, whereas paper B was produced from a 100% wood pulp furnish. Characteristics of single ply samples of these papers are given in Table 1 below.

TABLE 1

| Paper | Substance ($g/m^2$) | Calliper (microns) | Tensile Strength (N/15 mm width) |
|---|---|---|---|
| A | 17.6 | 95.0 | 0.89 |
| B | 19.1 | 111.3 | 1.04 |

The tensile strength values in Table 1 are those determined in the machine direction of the samples.

The moisture disintegrative index value of a single ply sample of paper A was found to range between 15 and 17. A twin ply sample of paper A, of a lesser substance than the single ply sample, had a moisture disintegrative index value of 18.

The moisture disintegrative index of a single ply sample of paper B was found to be of a value of 4.

Bobbins of papers A and B were used for the making of filter rod on paper-filter making machines. Cut-off devices of these machines were set to provide rods of 120 mm length. On a first such machine the paper web was crimped by means of passing the web between a pair of heated crimping rollers. In the case of this first machine the temperature of the crimping rollers and the depth of crimp could be varied, such variability providing means whereby the pressure drop of the filters could be influenced. In the case of a second of the paper-filter making machines the bobbin width (=web width) was varied as a means of influencing filter pressure drop. Relevant data relating to 13 filter rod making trials are presented in Table 2.

The cigarettes were smoked under standard (ISO) machine smoking conditions and filtration efficiencies were measured for particulate matter, on a nicotine free and dry basis (NFDPM), and total nicotine alkaloids (TNA). Results are presented in Table 2.

Filter plugs from samples of the machine smoked cigarettes were subjected to a weathering regime in a Q.U.V. (Trade Mark) accelerated weathering tester, which apparatus was manufactured by the Q-Panel Company of Cleveland, Ohio, U.S.A.

The weathering regime consisted of repeated cycles, each of which cycles consisted of three sequencial phases, namely a 60° C. ultra violet phase of 1.5 hours duration, a 50° C. water spray phase of 30 minutes duration and a condensation phase of 30 minutes duration.

After the completion of nine of these cycles it was observed that the filter plugs of papers A and B had disintegrated to a marked degree. By contrast filter plugs of cellulose acetate or of conventional filtration paper exhibited, after the completion of the same nine cycles, little or no sign of disintegration.

TABLE 2

| PAPER | B | B | A | A | B | A | B | B | B | B | A | A | A |
|---|---|---|---|---|---|---|---|---|---|---|---|---|---|
| Number of Plies | 2.00 | 2.00 | 2.00 | 2.00 | 2.00 | 2.00 | 2.00 | 1.00 | 1.00 | 1.00 | 1.00 | 1.00 | 1.00 |
| Bobbin Width mm | 230.00 | 230.00 | 230.00 | 230.00 | 230.00 | 230.00 | 230.00 | 130.00 | 160.00 | 190.00 | 130.00 | 190.00 | 220.00 |
| Crimp Temp. ° C. | 130.00 | 130.00 | 80.00 | 80.00 | 130.00 | 80.00 | 80.00 | — | — | — | — | — | — |
| Crimp Depth mm | 0.55 | 0.40 | 0.60 | 0.35 | 0.45 | 0.45 | 0.45 | — | — | — | — | — | — |
| 120 mm Rod Weight g | 1.07 | 1.08 | 1.41 | 1.45 | 1.08 | 1.48 | 1.09 | 0.65 | 0.79 | 0.91 | 0.72 | 0.85 | 0.99 |
| Filter P.D. mm W.G. | 140.00 | 82.00 | 178.00 | 39.00 | 109.00 | 105.00 | 140.00 | 60.00 | 115.00 | 161.00 | 49.00 | 90.00 | 133.00 |
| % Filtration Efficiency | | | | | | | | | | | | | |
| NFDPM | 76.92 | 63.25 | 82.48 | 45.30 | 71.79 | 70.09 | 76.92 | 56.84 | 71.79 | 79.06 | 54.70 | 70.09 | 75.64 |
| TNA | 82.07 | 68.48 | 86.96 | 51.63 | 73.37 | 73.91 | 80.98 | 58.70 | 76.09 | 83.15 | 60.33 | 74.46 | 79.35 |

The filter rod from each of the 13 trials was used to provide filters, each of 20 mm length, for cigarettes. A single specification was common to the tobacco rod of all of these cigarettes. The specification comprised features as follows.

| | |
|---|---|
| Length | 64.00 mm |
| Circumference | 24.68 mm |
| Tobacco Density | 247 mg/cc |
| Tobacco Type | Predominantly flue cured |

What is claimed is:

1. A smoking article comprising a smoking material rod and a filter, said filter comprising as filtration material moisture disintegrative paper, wherein the value of the moisture disintegration index of said paper does not exceed 10.

2. A smoking article according to claim 1, wherein said index does not exceed 7.

* * * * *